United States Patent [19]

Seager

[11] Patent Number: 4,592,482

[45] Date of Patent: Jun. 3, 1986

[54] HANDLE MECHANISM FOR COOLER OR THE LIKE

[75] Inventor: Richard H. Seager, Mystic, Conn.

[73] Assignee: King-Seeley Thermos Co., Norwich, Conn.

[21] Appl. No.: 207,022

[22] Filed: Nov. 14, 1980

[51] Int. Cl.[4] ..... B65D 25/28; B65D 25/32; B65D 45/04

[52] U.S. Cl. ..... 220/318; 220/94 R; 220/95

[58] Field of Search ..... 220/318, 94 R, 95

[56] References Cited

U.S. PATENT DOCUMENTS

| | | | |
|---|---|---|---|
| 1,616,288 | 2/1927 | Taliaferro | 220/95 |
| 2,338,082 | 1/1944 | Brewton | 220/94 R |
| 2,935,223 | 5/1960 | Crowley | 220/95 |

FOREIGN PATENT DOCUMENTS

| | | | |
|---|---|---|---|
| 71846 | 5/1916 | Austria | 220/318 |

OTHER PUBLICATIONS

*Best Products, 1979 Buyers Book*, p. 381, Item D, Copyright 1978.

*Primary Examiner*—George E. Lowrance
*Attorney, Agent, or Firm*—Ernest A. Beutler

[57] ABSTRACT

A portable cooler assembly embodying a reversible lid with a handle actuated latch mechanism for latching the lid in either of its two possible positions. The body portion of the cooler is formed with an upstanding flange around the lid so that the top of the lid is substantially flush with the body of the cooler regardless of how it is placed on the cooler body. The handle is nested between this upstanding flange and the lid when the handle is in a storage position so as to provide an uncluttered appearance and to protect the handle from accidental damage.

8 Claims, 7 Drawing Figures

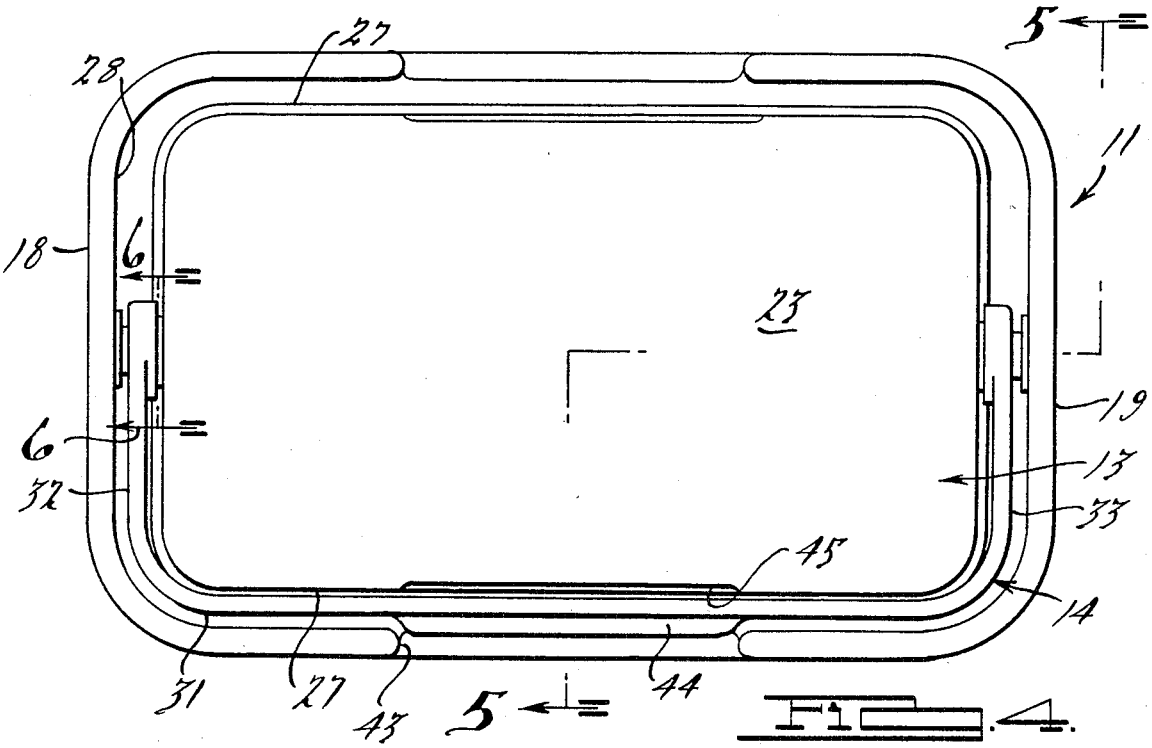
FIG. 4.
FIG. 5.
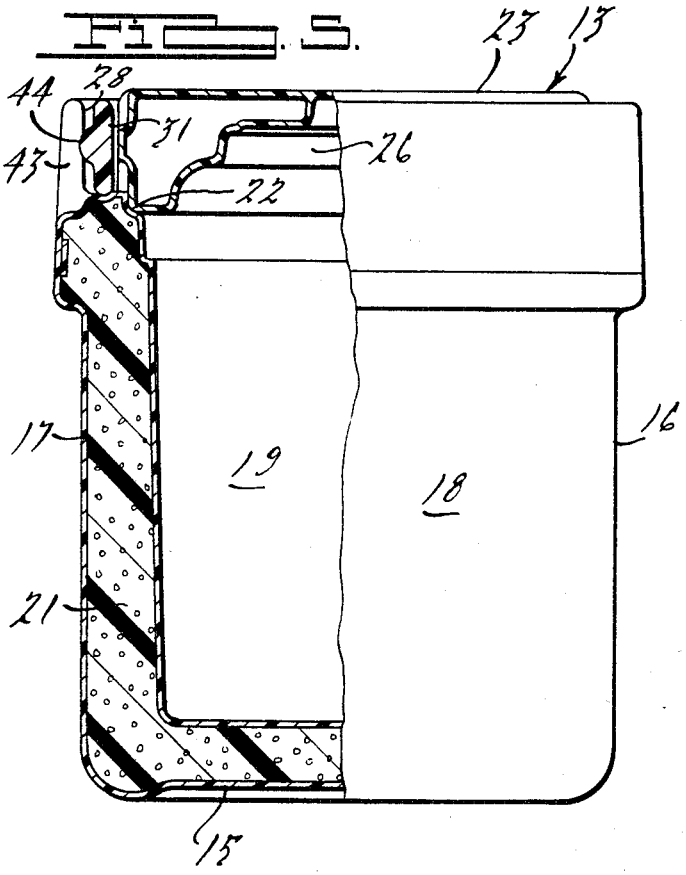
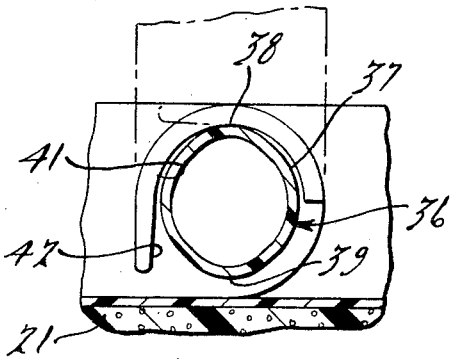
FIG. 6.
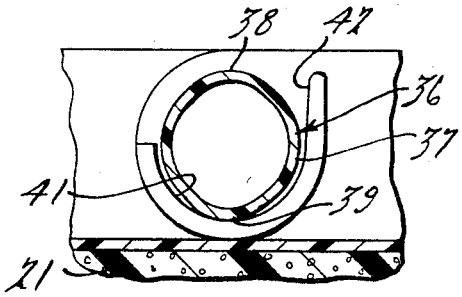
FIG. 7.

HANDLE MECHANISM FOR COOLER OR THE LIKE

BACKGROUND OF THE INVENTION

This invention relates to a portable cooler and more particularly to an improved handle mechanism for a portable cooler of the like.

It has been common practice to provide a carrying handle for portable coolers. Recently it has also been proposed to incorporate in such coolers an arrangement whereby the handle further functions as a latch to hold the cooler lid in place. With such an arrangement the handle is pivotal or otherwise moveable between an upright carrying position and a lowered position in which the latch is released and the cover may be removed from the cooler body. If the handle is in its carrying position, it extends across the lid and obstructs access to the cooler when the lid is removed, and thus the pivotal movement to a position away from the cooler opening is desirable even if the handle does not serve the function as a latch, in addition to its normal handle function.

In a cooler in which the handle is pivotal, as aforedescribed, the handle projects outwardly beyond the cooler body when in its non-carrying position. This produces an objectional appearance and may interfere with the use and storage of the cooler. Furthermore, the previously proposed pivotal supports for the handle of the cooler have positioned the handle in a location wherein it may be easily damaged through careless handling of the cooler.

It is therefore a principal object of this invention to provide an improved handle assembly for a portable cooler.

It is a further object of this invention to provide a cooler assembly having a pivotal handle which is concealed when not in use.

SUMMARY OF THE INVENTION

This invention is adapted to be embodied in a portable cooler assembly that includes a body portion, a lid, and a carrying handle. The body portion has a lower wall with upstanding side walls which define a cavity. The side walls also define an opening to the cavity above the lower wall. Side walls are insulated so as to maintain the desired temperature within the cavity and define a ledge below the upper edges which circumscribe the opening. The lid is adapted to be supported upon this ledge for closing the opening. The handle is supported for pivotal movement by opposite of the side walls about a horizontally disposed axis from an upright carrying position to a lowered storage position. The handle is configured to nest between the periphery of the lid and the interior surface of the upper edges of at least a portion of the opposite side walls and one of the interconnecting side walls when the handle is in its storage position so as to be substantially concealed.

BRIEF DESCRIPTION OF THE DRAWINGS

FIG. 4 is an enlarged top plan view of the cooler showing the handle pivoted to a storage position with the lid in the position shown in FIG. 1.

FIG. 5 is an enlarged partial cross-sectional view taken along the line 5—5 of FIG. 1.

FIG. 6 is an enlarged cross-sectional view taken along the line 6—6 of FIG. 4 showing the locking mechanism.

FIG. 7 is a cross-sectional view, in part similar to FIG. 6, showing the locking mechanism as it appears when the handle is pivoted to an unlocked, storage position.

DETAILED DESCRIPTION OF THE PREFERRED EMBODIMENT

Figure 1:
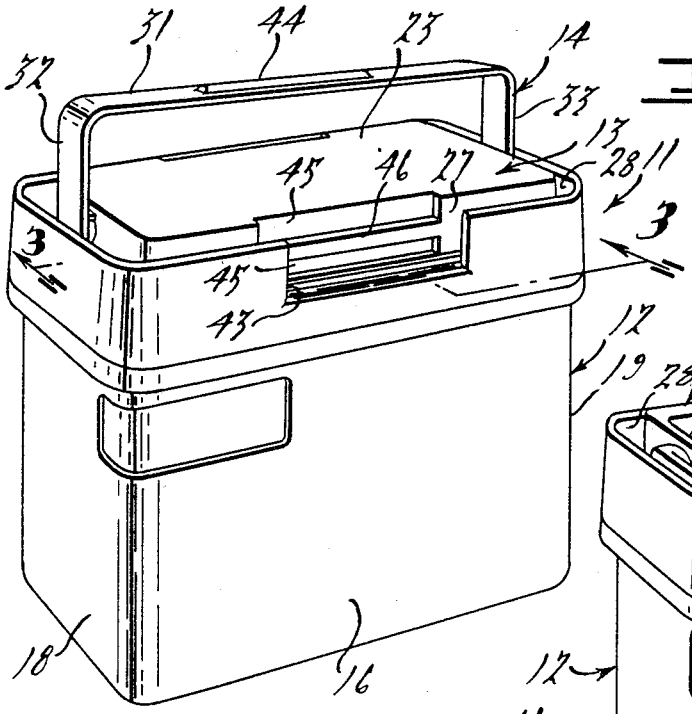
FIG. 1 is a perspective view of a portable cooler embodying this invention with the carrying handle pivoted to its upright carrying position.

In the drawings a portable cooler embodying this invention is identified generally by the reference numeral 11. The cooler 11 is comprised of a body portion 12, a lid 13, and a handle 14. All components of the cooler 11 may be conveniently formed from a suitable plastic by any known molding techniques.

The body portion 12 is of a double walled construction consisting of a lower wall 15, front and rear walls 16 and 17, and side walls 18 and 19. As may be noted from the cross-sectional views, the area between the double sides of the walls 15 through 19 is filled with a suitable insulating material 21. The insulating material 21 may be of any known type and preferably is one which may be foamed in place between the double walls. The inner portion of the walls defines a cavity which is open at its upper end and which is adapted to receive the contents to be stored, such as food, cans or the like, as is well known to this type of assembly.

At the upper edge of the opening, but below the top edges of the front and side walls 16, 17, 18 and 19, the innermost portion of the walls are formed with an intendation to provide a ledge 22. As will be noted hereinafter, the ledge 22 circumscribes the filling opening for the cavity and forms the support for the lid 13.

The lid 13 is also of a double wall construction and has a generally planar upper surface 23 which when exposed and the lid 13 is supported on the body portion ledge 22 provides a substantially flush closure for the cooler assembly 11. In a preferred form of the invention, the uppermost portion of the wall 23 is spaced slightly above a ridge 24 formed by the connection by the inner and outer wall portion of the front, rear and side walls 16, 17, 18 and 19.

Figure 2:
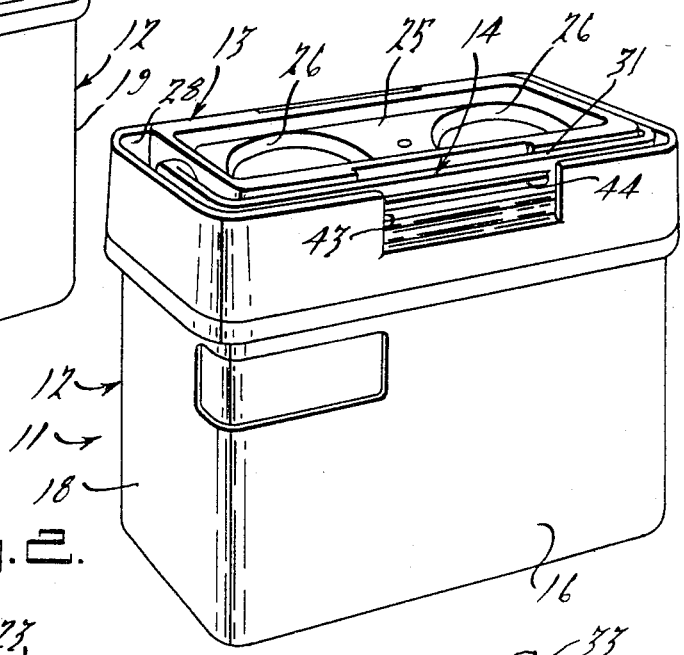
FIG. 2 is a perspective view, in part similar to FIG. 1, showing the lid of the cooler reversed and the handle pivoted to a storage position..
Figure 3:
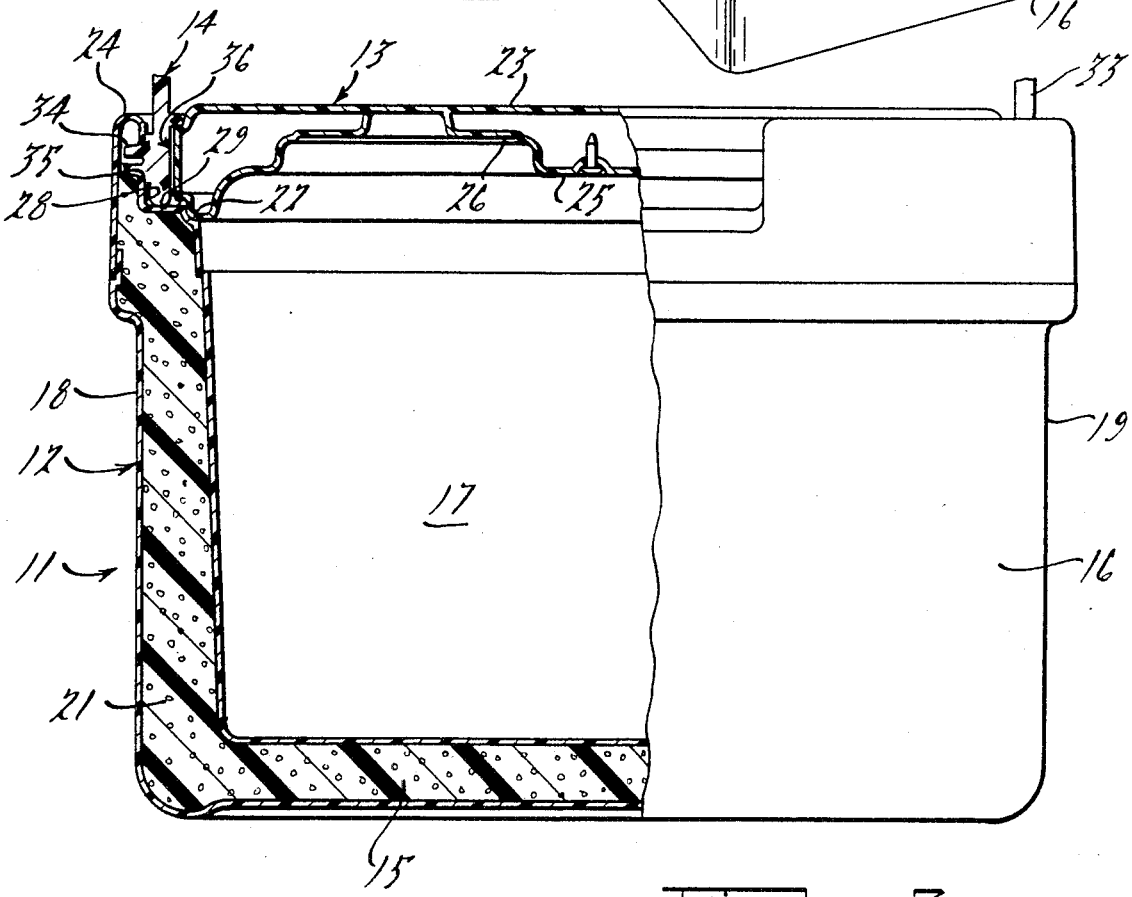
FIG. 3 is an enlarged partial cross-sectional view taken along the line 3—3 in FIG. 1.

The lowermost surface of the lid 13 is configured with a surface 25 in which depressions 26 are formed which may serve as receptacles for containers such as cans, cups of the like when the lid 13 is inverted to the position shown in FIG. 2. The outer periphery of both lid surfaces 23 and 25 is configured so as to be supported upon the ledge 22. In this way, the lid 13 may be supported on the body portions 12 with either the surface 23 exposed as shown in FIG. 1 or with the surface 25 and depressions 26 as shown in FIG. 2.

An outer margin 27 extends around the side of the lid 13 and is spaced inwardly from an upstanding flange 28 that extends completely around the front, rear and side walls 16 through 19. The flange 28 extends upwardly from the outer periphery of a horizontally extending flange 29 of all of the upstanding walls, which, in turn, is positioned outwardly of the sealing ledge 22.

The handle 14 has generally an inverted "U" shape consisting of a long intermediate leg 31 and shorter end legs 32 and 33. The long leg 31 extends for approximately the distance between the side walls 18 and 19 and particularly the distance between the flanges 28 thereof. The shorter legs 32 and 33 extend for approximately one half the distance between the front and rear walls 16 and 17, and specifically the distance between the upstanding franges 28 thereof. At the lower ends of the legs 32 and 33 slit projections 34 are formed which permit a snap connection into apertures 35 formed in the side wall flanges 28 so as to pivotally connect the handle 14 to the body portion 12. The pivot axis for the handle extends horizontally through the center of the cooler assembly across the upper opening.

The handle 14 is pivotal between an upright carrying position, as shown in FIG. 1, and lowermost storage positions. As will become apparent, there are in fact two lowermost storage positions for the handle 14; one adjacent the front wall 16 as shown in FIG. 2, and the other adjacent the rear wall 17. The first of these positions (adjacent the front wall 16) is a locking position, while the other position is an unlocked, storage position.

The handle is provided with a locking mechanism which co-acts with a pair of locking projections 36 formed on the lid 13 and extending outwardly from its outer margins 27. The locking projections 36 have a configuration as best shown in the cross-sectional views of FIGS. 6 and 7 and permit the lid 13 to be latched to the body portion 12 by the handle 14 in either of the two aforedescribed positions of the lid 13. The cross-sectional configuration of the projections 36 taken along a plane perpendicular to the pivot axis of the handle 14 is generally cylindrical, as indicated by the portion 37 except for the upper and lower locking portions 38 and 39. The locking portion 38 and 39 are also arcuate but have a smaller radium than the cylindrical portion 37. The outer termination of the locking portions 38 and 39 is blended into the cylindrical portion 37 in an appropriate manner.

The inner side of the handle legs 32 and 33 adjacent the locking projections 36 of the lid 13 are formed with cooperating locking portions. These cooperating locking portions consist of a cylindrical part 41 that extends through approximately 180 degrees and which terminates at one end in a generally tangentially extending lead-in part 42. The curvature of the locking part 41 is such that it will engage the uppermost surface of either the locking part 38 or 39 depending upon which direction the lid 13 is placed upon the body portion 12, and regardless of whether the handle 14 is in its locking position adjacent the front wall 16, as shown in the solid line view of FIG. 6, or when the handle 14 is pivoted to its upright carrying position as shown in the dot-dash line of FIG. 5. When the handle 14 is pivoted from its carrying position to its unlocked storage position adjacent the rear wall 17, as shown in FIG. 7, the surfaces 41 and 42 to not overlie any part of the locking projections 36 and the lid 12 may be easily removed from its position over the body portion cavity.

The width of the handle legs 31 and 32 is substantially equal to the upstanding flange 28 so that when the handle 14 is pivoted to either of its storage positions, it will be concealed within and protected by the upper portions of the front, rear and side walls 16 through 19. In order to facilitate pivotal movement of the handle 14 from either storage positions, the front and rear side walls 16 and 17 are provided with reliefs 43 at their central portions and the handle leg 31 is provided with a lug 44 so that the users' fingers may be readily slipped under the lug 44 through the reliefs 43 to pivot the handle 14 to its upright carrying position. The lid 13 is also provided with a pair of indentations 45 which are substantially co-extensive with the reliefs 43 and which result in the formation of a handle-like part 46 of the lid 13 which permits the lid 13 to be grasped and removed and replaced.

It should be readily apparent that the described construction permits a neat, compact assembly in which the handle 14 will be concealed and protected when in either of its storage positions. The construction also permits latching of the lid 13 in either of two positions. If desired, opposite sides of the handle 14 may be provided with an appropriate legend so that the user may readily determine whether the handle 14 is in its locked or released position. Various changes and modifications may be made without departing from the spirit and scope of the invention, as defined by the appended claims.

I claim:

1. A portable cooler assembly comprising a body portion, said body portion having a lower wall and upstanding side walls defining a cavity, said side walls defining an opening to said cavity above said lower wall, said walls being insulated to maintain a desired temperature in said cavity, said side walls defining a generally planar ledge below their upper edges and circumscribing said opening, a lid adapted to be supported directly upon said ledge for closing said opening, a handle supported for pivotal movement by opposing of said walls about a horizontally disposed axis from an upright carrying position to a lowered storage position, said handle having a configuration to nest between the outer peripheral edges of said lid and the inner surfaces of the edges of a portion of said opposing side walls and one of the interconnecting side walls that extend above said ledge when said handle is in its storage position said lid having a locking projection formed thereon extending outwardly therefrom and positioned below the upper edges of said side walls when said lid is supported on said body portion and latch means on said handle adapted to coact with said locking projection when said handle is in at least one of said positions for locking said lid to said body portion.

2. A portable cooler assembly as set forth in claim 1 wherein the pivotal axis of the handle is in the middle of the opposing side walls.

3. A portable cooler assembly as set forth in claim 2 wherein the width of the handle is no greater than the height of the inner surface of the edges of the side walls extending above said ledge so that said handle is concealed when in its storage position.

4. A portable cooler assembly as set forth in claim 3 wherein the upstanding edges of the innerconnecting side wall is formed with an central recess so that the intermediate portion of the handle may be grasped therethrough when the handle is in its storage position.

5. A portable cooler assembly as set forth in claim 1 wherein the pivotal axis of the handle is in the middle of the opposing side walls, said handle further being pivotal to a second storage position on the opposite side of the body portion adjacent the remaining side wall.

6. A portable cooler assembly as set forth in claim 5 wherein the latch means is in its released position when the handle is in its second storage position.

7. A portable cooler assembly as set forth in claim 6 wherein the lid has a first surface adapted to be exposed at the top of the cooler when the lid is positioned on the body portion in a first position and a second surface having a different configuration from said first surface and adapted to be exposed when said lid is on said body portion in an inverted portion, said locking projection of said lid being configured for cooperation with said latch means for operation of said latch means to retain said lid on said body portion in either position of said lid.

8. A portable cooler assembly as set forth in claim 7 further including indicia means on the handle for indicating whether the handle is in its locked or unlocked storage position.

* * * * *